United States Patent [19]

Stog

[11] 4,316,773

[45] Feb. 23, 1982

[54] HOOD CAR FOR THE ABSORPTION OF EMISSIONS LIBERATED UPON PUSHING OF COKE OVENS

[76] Inventor: Wilhelm Stog, In der Baut 9, 4355 Waltrop, Fed. Rep. of Germany

[21] Appl. No.: 120,104

[22] Filed: Feb. 8, 1980

[30] Foreign Application Priority Data

Feb. 10, 1979 [DE] Fed. Rep. of Germany ..... 2905109

[51] Int. Cl.[3] ..... C10B 33/00; C10B 45/00

[52] U.S. Cl. ..... 202/263; 55/97; 55/267; 165/10

[58] Field of Search ..... 201/39; 202/227, 263; 55/97, 267; 165/10

[56] References Cited

U.S. PATENT DOCUMENTS

| | | | |
|---|---|---|---|
| 2,372,194 | 3/1945 | Gaertner | 165/7 X |
| 2,790,505 | 4/1957 | Dow | 165/7 X |
| 3,395,512 | 8/1968 | Finney, Jr. et al. | 55/97 X |
| 3,868,309 | 2/1975 | Sustarsic et al. | 202/263 X |
| 4,209,061 | 1/1980 | Schwemin | 165/10 |

FOREIGN PATENT DOCUMENTS

| | | | |
|---|---|---|---|
| 399632 | 3/1922 | Fed. Rep. of Germany | 165/10 |
| 597686 | 11/1925 | France | 165/10 |
| 265832 | 2/1927 | United Kingdom | 165/10 |

*Primary Examiner*—Bradley Garris
*Attorney, Agent, or Firm*—Karl F. Ross

[57] ABSTRACT

A hood car for recovering dust-laden gas upon the discharge of a coke from a coke oven has, in the duct running from the upper end of the hood to the dust-removal unit, a recuperator in the form of at least one grate constituted by flat bars in an eggcrate array.

9 Claims, 4 Drawing Figures

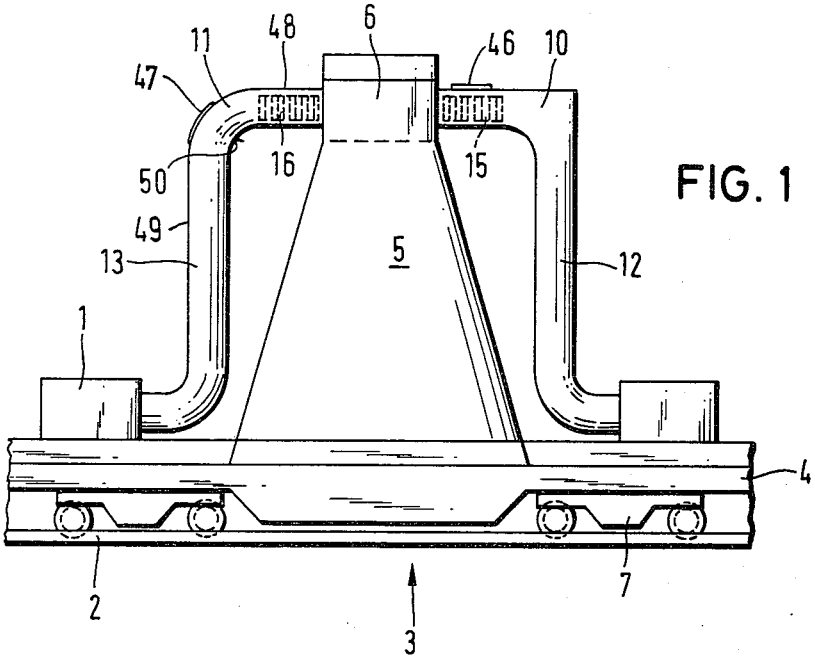
FIG. 1
FIG. 2
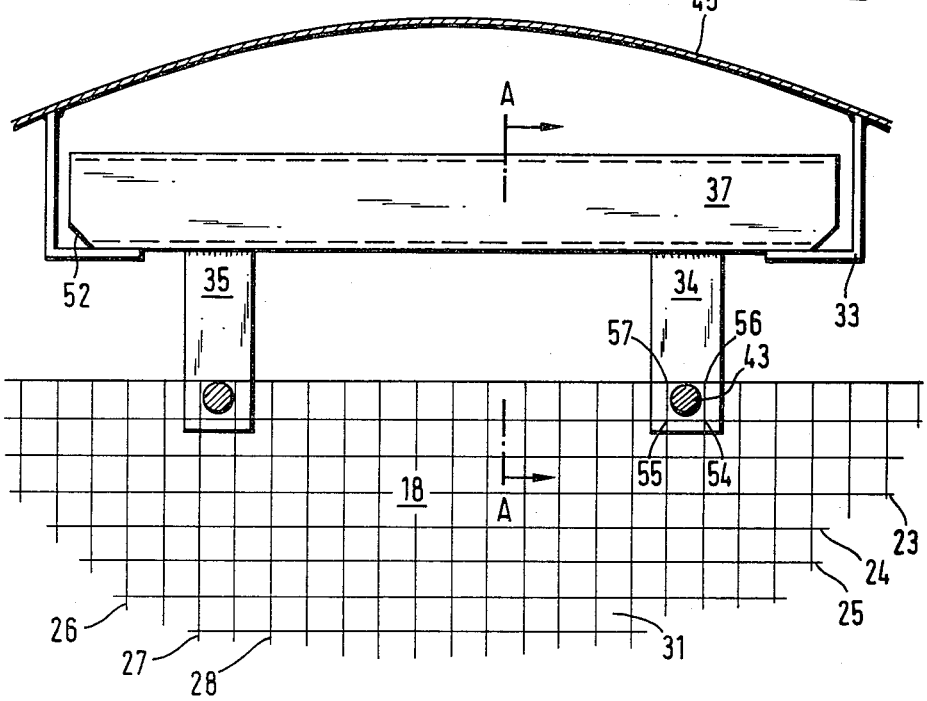

HOOD CAR FOR THE ABSORPTION OF EMISSIONS LIBERATED UPON PUSHING OF COKE OVENS

The invention relates to a hood car for the collection of emissions liberated upon pushing of coke ovens with an exhaust and dedusting apparatus, wherein the hot gases fed by exhaust channels and exhaust lines located at the top of the hood are purified, and wherein recuperators are disposed in the cross-section of the exhaust channels for reducing the top temperatures.

BACKGROUND OF THE INVENTION

Hood cars are used in coke plants because of increasingly stringent environmental protection regulations in order to avoid as much as possible the release of fumes , dust and odor upon pushing of the coke, i.e. when glowing coke is pushed out of the hot oven chamber. The liberated emissions are drawn into the hood by the underpressure generated in the hood and are then drawn into the dedusting apparatus via exhaust channels and lines. Because of the high temperatures of the glowing coke each time a relatively large volume of gas has, during the pushing process, to be processed. Between the individual pushing steps air of normal temperature is drawn in and guided through the channels. During this process the walls of the exhaust channels cool down and result during the pushing process in a cooling of the hot, dust-laden gases.

It is known to hang tubes of a special material in the flow cross-sections of the exhaust channels, in order to increase this temperature effect. With the cooling of the exhaust gases, which enter at about 350° to 400° C. there is a volume decrease, which allows the following dedusting apparatus to be made smaller. A disadvantage is however that the tubes are composed of a special material and nearly fill the cross-section of the exhaust channels. Because of the high cost of this material and the need for a special process of manufacture these systems are disadvantageous. Since the gas flow passes through the individual tubes of relatively large length without turbulence, the larger dust particles carried over tend to deposit and in the long run clog up individual tubes.

OBJECT OF THE INVENTION

It is an object of the invention, to provide a hood car having a recuperator giving a larger temperature decrease and hence a volume decrease of the hot gas stream, which impedes dust deposits and which is easily adaptable to changing conditions.

SUMMARY OF THE INVENTION

This object is attained in accordance with the present invention by composing recuperators from several bar grates, which are formed from individual crossed flat irons (bars) and which are arranged in the exhaust channels successively in the flow direction.

It is possible with the aid of the invention, to change as desired the capacity of the recuperator and to adapt it to requirements. It has been found that such bar grates render possible as good heat exchange which is as effective as that of the much more involved and more expensive tubes of special material. Since a much larger heat-exchange surface can be provided with such bar grates, it is possible to decrease the temperatrue of the gas stream further with the result that the following gas-processing units can be smaller.

According to one feature of the invention it is provided that eggcrate gratings serve as recuperators. Eggcrate gratings are usually employed for the covering of manholes, channels or the like. For this reason they are generally protected against corrosion, so as to resist without anything further relatively corrosive gases. It is particularly advantageous that such eggcrate gratings represent a mass produced article which can be manufactured at favorable prices.

In order to increase the heat exchange and to avoid the deposition of dust particles, in a preferred embodiment of the present invention the gratings are disposed in flow direction so as to be movable longitudinally and/or crosswise. Thus it is possible to generate by an appropriate successive placing of the individual eggcrate gratings air turbulences, which provide the desired degree of heat exchange and which prevents simultaneously the deposition of dust particles. In a further embodiment of the invention several eggcrate gratings are combined to a unit and are attached to the wall of the exhaust channels via a joint support system. The individual eggcrate gratings or the complete eggcrate gratings units can be displaced with respect to each other or if desired also positioned exactly in a row one after the other. Thus an adaptation of the recuperators to the changing conditions is possible, which can be further increased by hanging additional units in the exhaust channels.

In order to simplify the hanging and replacement of the individual eggcrate gratings and eggcrate gratings units, respectively, closable openings are provided in the horizontal part of the exhaust channels or/and in the vertical part of the channel knee in juxtaposition with the eggcrate gratings. Hereby, it is possible to lift the eggcrate deckings or units out of the channels or to pull them out from the side. The assembly, maintenance and appropriate capacity adaptation are much facilitated by the provision of such closable openings.

The simple assembly and maintenance as well as the movable positioning of the eggcrate gratings is safely achieved by having the eggcrate gratings connected with straps to struts serving as support elements, which struts rest on angle irons attached to the wall of the exhaust channels. The individual eggcrate gratings or the combined units, rest safely on the angle irons based on their weight without change in position even with continuously changing gas velocities within the exhaust channels.

Shifting of the eggcrate gratings and of the combined units, respectively, is additionally prevented by providing at the upper side of the eggcrate gratings two straps and at the bottom side one strap.

The forces and momenta which are to be contained by the bar grates and the support system are safely transferred to the wall of the exhaust channels when the struts according to the invention are formed as U-profiles and the rib is disposed in the channel cross-section crosswise to the flow direction. Thus the bar grates or the combined units are given the necessary stability, which avoids in combination with the other proposed measures an unintended shifting, fluttering or similar disadvantageous situation.

The flow inside the recuperators can be varied or adapted to the situations in a particularly favorable manner by having the longitudinally and crosswise running flat irons form square openings each time. Thus it is directly possible even upon shifting of individual grates against each other to provide geometrically favorable flow channels. Thus air turbulences can be intentionally produced and an intense contact of the gas stream with the flat iron can be induced and the desired heat exchange can be provided.

In accordance with a further feature of the invention the successive units of eggcrate gratings in the flow direction can have openings of different sizes. This allows an increase in the velocity of the gas stream traversing the recuperator by having for example upstream bar grates with larger openings and downstream grates with smaller and smaller openings.

BRIEF DESCRIPTION OF THE DRAWING

The invention is illustrated in the drawing in greater detail with reference to a preferred embodiment. In the drawing:

FIG. 1 is a schematic complete representation of a hood car;

FIG. 2 is a partial section through an exhaust channel with recuperator;

SPECIFIC DESCRIPTION

Figure 3:
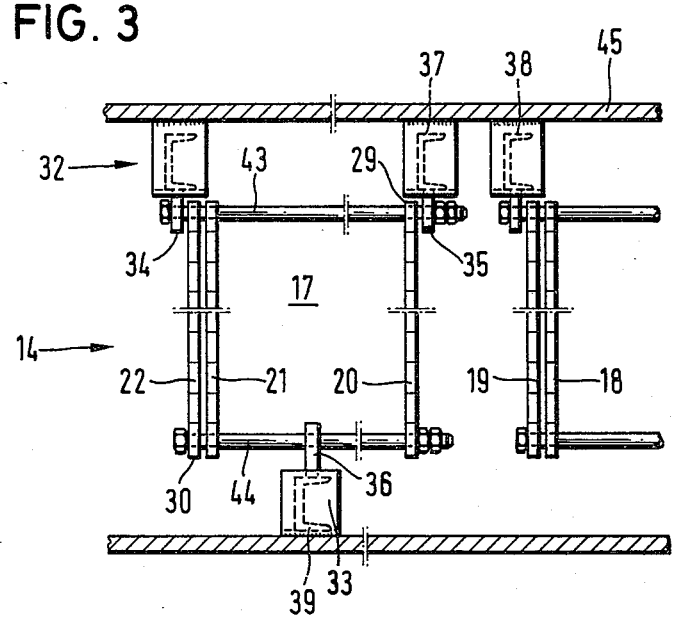
FIG. 3 is a partial view of a longitudinal section of the same exhaust channel.

The hood car 3 movable on rails 2 as shown schematically in FIG. 1 comprises a chassis 7, on which the hood 5 with its additional aggregates is supported via the vehicle frame 4. The fumes flowing, upon pushing of the coke ovens, into the hood 5 are gathered at the top 6 of the hood 5 and are then drawn via the exhaust channels 10, 11 and the exhaust conduits 12, 13 into the dedusting apparatus 1 and are there purified. The recuperators 15, 16 are located in the exhaust channels 10, 11 immediately adjacent the top of the hood 5. In the horizontal part 48 an opening 46 is provided allowing assembly and maintenance of the recuperator 15. The opening 47 at the vertical part 49 of the channel knee 50 has the same purpose. As can be seen from FIG. 1 the recuperators 15, 16 can be installed or dismounted, supplemented or maintained in this manner.

Each time before the pushing of the coke oven the hood car is placed in front of it for allowing with the aid of the not shown coke guide car a pushing out of the glowing coke cake while closed against the atmopshere. The glowing coke is thereby pushed into a quenching car (not shown). The fumes liberated herewith, which also contain tar-containing residues, are prevented by way of the underpressure under the hood 5 from escaping into the atmosphere.

After reaching the top of the hood they pass into the exhaust channels 10, 11, where they are brought into contact with the recuperators 15, 16, then they stream through the exhaust conduits 12, 13 and are finally purified in the dedusting apparatus 1 from dust particles, damaging chemical components and mostly from odor components. After the end of the coke pushing process the recuperators are traversed by a gas having a maximum temperature of 350° to 400° C. for a time of about 1.5 sec. They abstract from this gas a large part of its heat and release it to the latter following cooler air so that the total volume of the sucked in air/gas stream remains about the same. Thus it is possible to make the aggregates following the recuperators 15, 16, i.e. the dedusting apparatus relatively small.

The construction of the recuperators and their attachment to the wall 45 of the exhaust channels 10, 11 is clarified in FIGS. 2 and 3. The eggcrate gratings 18 formed from longitudinally running flat bars 23–25 and from crosswise running flat iron 21–28 is arranged such that the square openings 31 allow passing of the fume gases. The bar grate 18 is herein suspended by the straps 34, 35 and the strut 37 from the angle iron 33 or the strut 37 rests on the angle iron 33, respectively. The bevel 52 provided at the lower corners of the strut 37 facilitates the assembly.

At the upper side 29 the eggcrate grating 18 is connected to the corresponding struts 37–39 via the straps 34, 35 and as shown in FIG. 3 at the underside 30 via the strap 36.

Figure 4:
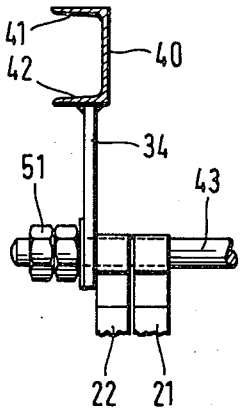
FIG. 4 is a detail of the attachment of the recuperator.

In order to accommodate temperature variations as well as desired shifts to the side, a slot is left open between the angle iron 33 and the struts 37–39 on both sides. The struts 37–39 form U-profiles and the rib 40 is each time placed in the flow direction 14 as shown in FIG. 3 and FIG. 4, respectively. Thus the two wings 41, 42 are directed in flow direction assuring in this range a favorable course of flow.

The parts serving as a support 32 provide the necessary stability to the total system, which can be further enhanced by providing flow direction 14 with several eggcrate gratings 18–22 combined to units 17 as shown in FIG. 3. The eggcrate gratings 18–22 are advantageously uniformly supported on the cross bars 43, 44 whereon they can possibly be shifted. By means of the nuts 51 an easy assembly and demounting is also assured in this range. The openings 31 formed by flat iron 23–28 are preferably square according to the present invention. The spacing of the individual flat irons 23–28 can vary with respect to each other so that the size of the openings 31 can differ. Thereby and via the number and arrangement of the eggcrate gratings 18–22 with respect to each other the capacity, that is the heat absorption capacity of the recuperators 15, 16 can be adapted each time to the corresponding situation.

The cross bars 43, 44 are preferably provided at their ends with threads for allowing combination of the eggcrate grates to compact units 17. The straps 34–36 are therein provided of such width as to correspond about the double width of the opening 31. Thus the strap is supported by several cross points 54–57 each time. This increases the stability and it becomes possible to shift the individual units 17 as far as possible and necessary on the angle iron 33 in longitudinal or cross direction. The angle iron 33 is thereby preferably attached to the wall 45 by welding.

In the example shown eggcrate gratings of b 1000×1000 are provided, wherein the individual openings 31 have dimensions of 30×30×3. It has been found that the successive arrangement of eggcrate gratings in flow direction 14 is sufficient to cool the fume gases by about 100° C. Herein a time span of 80 sec is sufficient to cool down again the recuperator comprising the eggcrate gratings 18–22.

I claim:

1. A hood car for withdrawing dust-laden gases from coke during pushing of a coke oven, said car comprising:

a chassis shiftable along a path parallel to a coke oven;

a downwardly open hood mounted on said chassis for collecting dust-laden gas upon the discharge of coke from said coke oven, said hood having an upper end;

a duct connected to said upper end of said hood for drawing dust-laden gas from said hood;

at least one dust-treating unit connected to said duct for treating gas drawn from said hood; and at least one recuperative heat exchanger in said duct between said hood and said unit, said heat exchanger comprising at least one flat grate extending transverse to a direction of flow of gas through said duct and composed of flat iron bars disposed in an eggcrate configuration with edges turned into said direction of flow, and means for mounting said grate in said duct whereby said grate is cooled by air passing through said duct prior to the flow of dust-laden gas from the discharge of the coke oven to subsequently cool said dust-laden gas.

2. The hood car defined in claim 1 wherein said recuperative heat exchanger comprises a plurality of such grates disposed in succession along said duct.

3. The hood car is defined in claim 2 wherein said means for mounting said grates is constructed and arranged to enable the relative positions of said grates to be adjusted.

4. The hood car defined in claim 2, further comprising means for interconnecting said grates into a grate unit, said means for mounting said grates being constructed to allow movement of said grate unit within said duct.

5. The hood car as defined in claim 2 wherein the duct is formed with a horizontal portion opening into said upper end of said hood and containing said grates directly adjacent said hood, said horizontal portion being provided with an opening affording access to said grates, and a removable cover closing said opening.

6. The hood car defined in claim 2 wherein said duct has a horizontal portion extending from said upper end of said hood and receiving said grates and a downward bend adjacent said grates, said bend being provided with an opening affording access to said grates, and a removable cover closing said openings.

7. The hood car defined in claim 2 wherein said means for mounting said grates includes a pair of channels extending across said duct and resting at opposite ends on respective angle irons mounted on said duct, pairs of straps extending downwardly from said angle irons and anchored to opposite upper corners of said grates and a further strap secured to a lower portion of said grates.

8. The hood car defined in claim 7 wherein said grates have square openings.

9. The hood car defined in claim 8 wherein said openings of successive grates in the direction of flow of gas through said duct have different dimensions.

* * * * *